US006349947B1

(12) United States Patent
Turner et al.

(10) Patent No.: US 6,349,947 B1
(45) Date of Patent: Feb. 26, 2002

(54) HIGH PRESSURE CHAMBER DOOR SEAL WITH LEAK DETECTION SYSTEM

(75) Inventors: Jon R. Turner, Lakeville, IL (US); A. Duane Preston, New Prague, MN (US)

(73) Assignee: MVE, Inc., New Prague, MN (US)

( * ) Notice: Subject to any disclaimer, the term of this patent is extended or adjusted under 35 U.S.C. 154(b) by 0 days.

(21) Appl. No.: 09/338,870

(22) Filed: Jun. 23, 1999

(51) Int. Cl.[7] ..... F16J 15/10
(52) U.S. Cl. ..... 277/641; 277/318; 277/910
(58) Field of Search ..... 277/318, 609, 277/630, 641, 910, 928; 285/93, 352

(56) References Cited

U.S. PATENT DOCUMENTS

| | | | | | |
|---|---|---|---|---|---|
| 954,668 | A | * | 4/1910 | Cable et al. | 277/641 X |
| 3,077,360 | A | | 2/1963 | Israel | |
| 3,573,870 | A | * | 4/1971 | Gastineau et al. | 277/609 |
| 3,678,624 | A | | 7/1972 | Bicicchi | |
| 3,724,861 | A | * | 4/1973 | Lesiecki | 277/318 X |
| 4,192,483 | A | * | 3/1980 | Combes | 277/641 X |
| 4,369,893 | A | * | 1/1983 | Pennell et al. | 277/641 X |
| 4,494,760 | A | * | 1/1985 | Spargo | 277/910 X |
| 4,577,870 | A | | 3/1986 | Scott et al. | |
| 4,722,534 | A | * | 2/1988 | Wentworth | 277/318 X |
| 4,795,173 | A | | 1/1989 | Osborne | |
| 4,866,934 | A | * | 9/1989 | Lindstedt | 277/641 X |
| 4,993,720 | A | * | 2/1991 | Giotola | 277/641 |
| 5,090,871 | A | * | 2/1992 | Story et al. | 277/910 X |
| 5,267,455 | A | | 12/1993 | Dewees et al. | |
| 5,280,924 | A | * | 1/1994 | Burgess | 277/910 X |
| 5,344,493 | A | | 9/1994 | Jackson | |
| 5,412,958 | A | | 5/1995 | Iliff et al. | |
| 5,651,276 | A | | 7/1997 | Purer et al. | |
| 5,669,251 | A | | 9/1997 | Townsend | |

FOREIGN PATENT DOCUMENTS

| | | | | |
|---|---|---|---|---|
| CA | 985326 | * | 3/1976 | 277/318 |
| GB | 2032562 | * | 5/1980 | 285/93 |

OTHER PUBLICATIONS

Tube Turns, Imc's Advertisement "Serving the Oil, Gas, Chemical and Petrochemical Industries for 60 Years and Into the Twenty–First Century!!".

* cited by examiner

*Primary Examiner*—Robert G. Santos
(74) *Attorney, Agent, or Firm*—Piper Marbury Rudnick & Wolfe

(57) ABSTRACT

A high pressure chamber opening is equipped with a cylindrical element that features a circumferential flange. The circumferential flange features concentrically positioned primary and secondary O-ring seals that surround the chamber opening. A door is clamped to the circumferential flange and over the opening and the circumferential seals. As a result, the opening is sealed and an annular passage is formed between the seals. A port is formed in the cylindrical element so that the annular passage may communicate with a pressure switch. The port also communicates with a relief valve. The pressure switch signals the system operator when the pressure in the annular passage rises due to failure of the primary O-ring. The relief valve vents the annular passage when the pressure therein increases to a level where damage to the secondary O-ring could occur. The relief valve setting is such that the pressure within the annular passage may rise to a level where dry ice formation is prevented.

18 Claims, 4 Drawing Sheets

HIGH PRESSURE CHAMBER DOOR SEAL WITH LEAK DETECTION SYSTEM

BACKGROUND

The present invention generally relates to high pressure chamber doors seals, and, more particularly, to a chamber door that utilizes dual seals and features a leak detection system.

Liquid carbon dioxide dry cleaning systems have recently been developed in response to the environmental, health and safety concerns that are associated with systems that utilize perchloroethylene ("perc") or petroleum-based solvents. Liquid carbon dioxide is a solvent that is an inexpensive and an unlimited natural resource. Furthermore, liquid carbon dioxide is non-toxic, non-flammable and does not produce smog. Liquid carbon dioxide does not damage fabrics or dissolve common dyes and exhibits solvating properties typical of more traditional solvents. Its properties make it a good dry cleaning medium for fabrics and garments. As a result, several dry cleaning systems utilizing carbon dioxide as a solvent have been developed.

An example of a liquid carbon dioxide dry cleaning system is presented in commonly owned U.S. Pat. No. 5,904,737 to Preston et al. The system of the Preston et al. '737 patent, which also may be used to clean mechanical parts or electrical components, features a chamber within which the items to be cleaned are placed. The interior of the chamber is accessed via a hinged door that seals when the system is in use. The chamber interior is equipped with a number of jets that are selectively in communication with a high pressure supply of liquid carbon dioxide. At the beginning of the cleaning process, the chamber is evacuated and pressurized to an intermediate pressure of approximately 70 psi. The chamber is then pressurized to approximately 650 to 690 psi as it receives liquid carbon dioxide at a temperature of approximately 54° F., a temperature at which carbon dioxide acts as an effective solvent. Liquid carbon dioxide is then circulated through the chamber via the jets so that the items therein are agitated and cleaned.

While the system of the Preston et al. '737 patent agitates by jets, a variety of other chamber agitation arrangements exist. For example, the cleaning chamber may feature a rotating drum (known as the fall-and-splash technique) or a source of gas bubbles. Regardless of the agitation technique of the system, however, the chambers are pressurized so that they may contain liquid carbon dioxide at an appropriate temperature. As such, it is critical for all liquid carbon dioxide (or other solvents requiring high pressure) dry cleaning systems to possess chambers with doors that may be effectively sealed.

Prior chambers typically employ a large rubber O-ring seal between the chamber opening and the chamber door. The O-ring is compressed when the chamber door is closed so that an effective seal is formed. Such an arrangement, however, fails to provide a backup or secondary seal in the event that the O-ring fails. Furthermore, such a sealing arrangement may fail without warning. In such a situation, the liquid carbon dioxide could leak into the cleaning plant, which is undesirable from a safety standpoint.

Accordingly, it is an object of the present invention to provide a high pressure chamber door seal that features a primary seal and a secondary seal.

It is a further object of the present invention to provide a high pressure chamber door seal that features a leak detection system.

It is a further object of the present invention to provide a high pressure chamber door seal that provides a warning to the system operator when the primary seal has failed.

It is still a further object of the present invention to provide a high pressure chamber door seal with a primary and secondary seal that resists dry ice formation between the primary and secondary seals.

It is still a further object of the present invention to provide a high pressure chamber door seal with a primary and a secondary seal that prevents exposure of the secondary seal to high pressure.

These and other objects of the invention will be apparent from the remaining portion of the Specification.

SUMMARY

The present invention is directed to a seal for a high pressure chamber opening. A cylindrical element featuring a circumferential flange is positioned around the opening of the high pressure chamber. The flange features a primary O-ring seal circumferentially surrounding the chamber opening. A secondary O-ring seal circumferentially surrounds the primary O-ring seal. A door is clamped to the circumferential flange so as to cover the opening and the primary and secondary seals. As a result, the opening is sealed and an annular passage is defined between the primary and secondary seals.

If the primary seal begins to leak, the pressure within the annular space will increase. A port is formed in the cylindrical element so that the annular passage between the seals may communicate with a pressure switch. The switch is activated when the pressure in the annular space rises above approximately 10 psi. The switch, when activated, sends a signal to the user display so that a warning message or other alarm may be provided. The system operator may then inspect and repair the faulty primary seal prior to the next chamber pressurization. The port of the cylindrical element also communicates with a relief valve that vents to the exterior of the building housing the system when the pressure in the annular space rises above approximately 70 psi. By allowing the pressure in the annular space to rise to over 60 psi, the arrangement prevents or minimizes the formation of dry ice. Dry ice is damaging to the secondary seal. By venting the annular space when the pressure rises above a predetermined level, the arrangement prevents damage to the secondary seal and thus avoids leakage of fluid into the building.

For a more complete understanding of the nature and scope of the invention, reference may now be had to the following detailed description of embodiments thereof taken in conjunction with the appended claims and accompanying drawings.

DESCRIPTION

Figure 1:
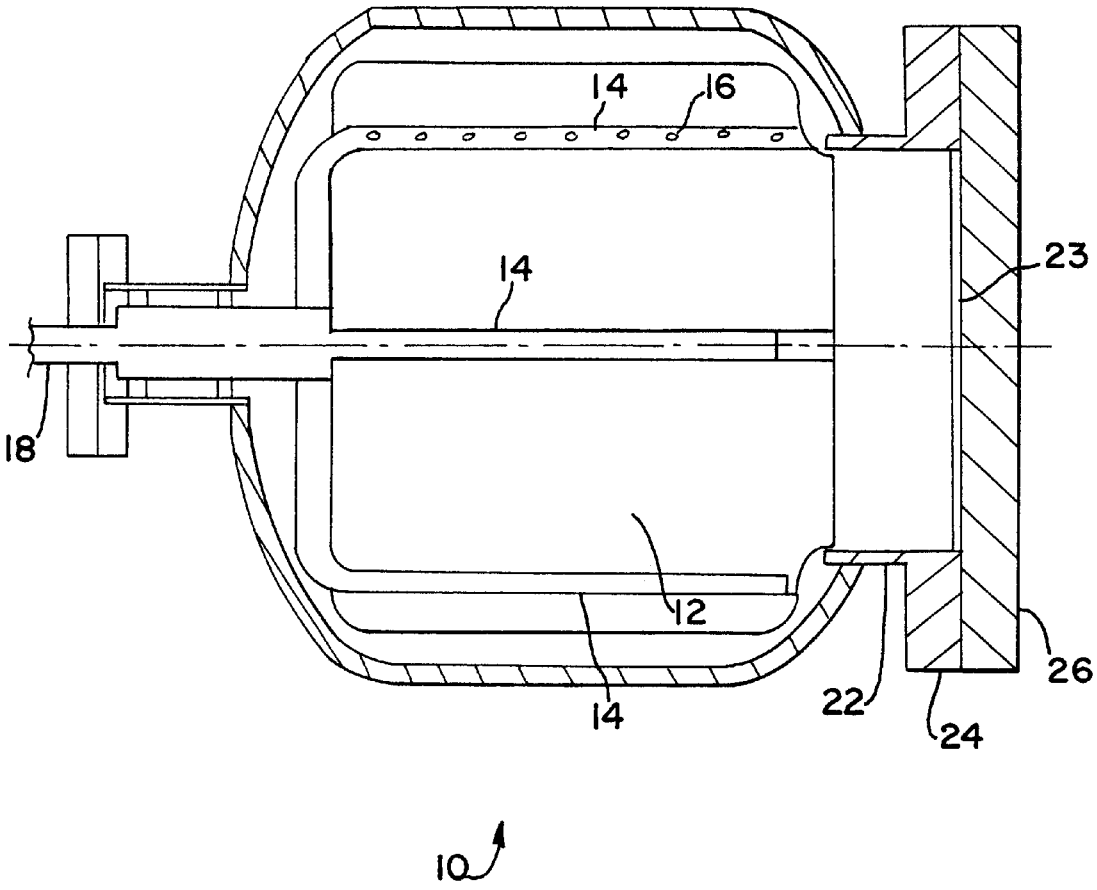
FIG. 1 PRIOR ART
FIG. 1 is a sectional view of a prior art cleaning chamber.

A prior art liquid carbon dioxide dry cleaning chamber is indicated in general at 10 in FIG. 1. The chamber interior 12 features two pairs of opposing tubes 14. Each opposing tube features a number of apertures or jets 16 and is in communication with a supply of high pressure liquid carbon dioxide via supply line 18. The jets are oriented such that a vortex is created within the chamber when liquid carbon dioxide is provided to the tubes 14 through the supply line 18. This vortex agitates the items within the chamber. The chamber may employ an alternative agitation arrangement such as, for example, a rotating drum or a source of gas bubbles. The chamber may alternatively provide no agitation and, as a result, rely solely upon the solvent capability of the liquid carbon dioxide to clean items placed therein.

A cylindrical element 22 is attached about the opening 23 of the chamber and features a circumferential flange 24. A hinged door 26 engages the flange 24 so that the interior 12 of the chamber is sealed. As will be described below, the present invention provides both primary and secondary seals between the flange 24 and the hinged door 26 and a system for detecting and indicating when the primary seal has been compromised.

Figure 2:
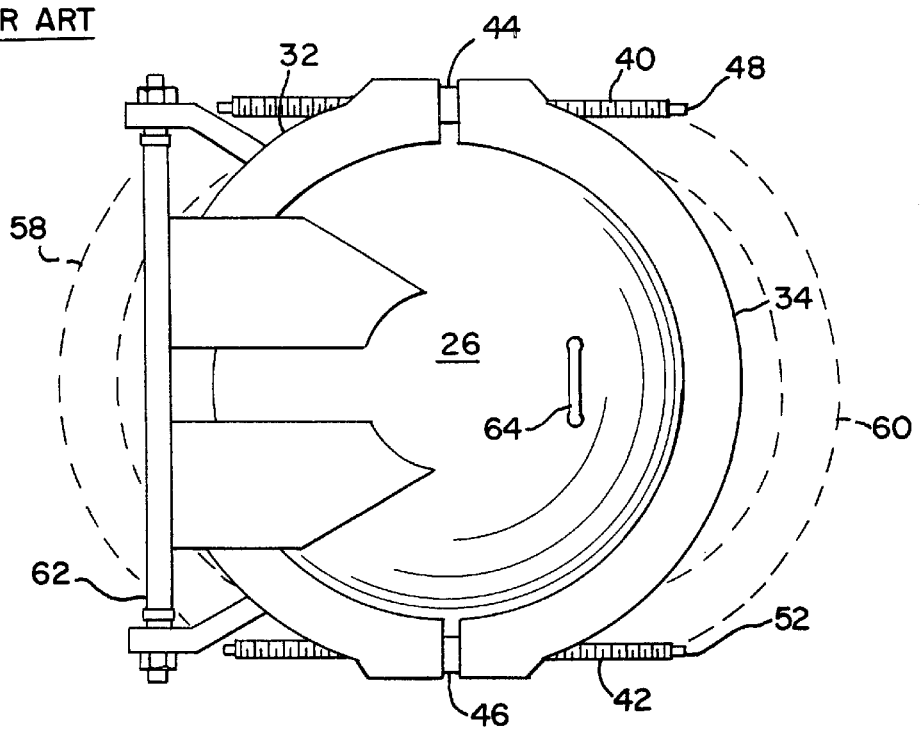
FIG. 2 PRIOR ART
FIG. 2 is a front elevation view of a prior art high pressure chamber door arrangement.
Figure 3:
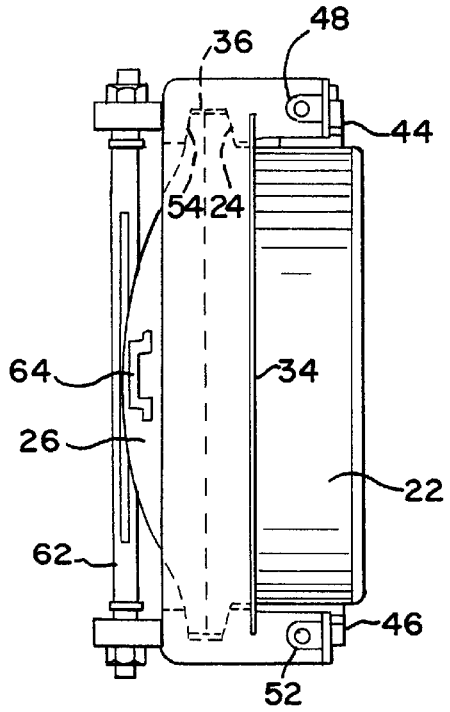
FIG. 3 PRIOR ART
FIG. 3 is a side elevation view of the high pressure chamber door arrangement of FIG. 2.

When in use, the chamber of FIG. 1 contains liquid carbon dioxide at a pressure of approximately 650 to 690 psi and temperature of approximately 54° F. In order to prevent the door from opening due to the high pressure of the chamber, latching arrangements such as the one illustrated in FIGS. 2 and 3 are employed. A segmental clamping ring, frequently referred to as a "yoke ring" features two semi-circular segments 32 and 34. Each segment 32 and 34 features an inward-facing groove, indicated in phantom at 36 in FIG. 3. The segments are oriented in a vertical plane and may be moved towards and away from one another by bolts 40 and 42. Bolts 40 and 42 are mounted to cylindrical element 22 in a rotatable fashion by brackets 44 and 46 and feature heads 48 and 52, respectively, which are suitably formed for engagement by wrenches or other operating tools.

When the segments 32 and 34 are in the closed position, as illustrated in FIGS. 2 and 3, their inward facing grooves 36 clamp the flange 24 of the cylindrical element 22 and the circumferential edge 54 of the door together, as illustrated in FIG. 3. When access to the interior of the chamber is required, the segments are moved to the position indicated in phantom at 58 and 60 in FIG. 2. The door may then be pivoted to an open position via hinge 62 and handle 64. The cylindrical element, door and latching arrangement of FIGS. 2 and 3 may be obtained from Tube Turns, Inc. of Louisville, Ky.

Figure 5:
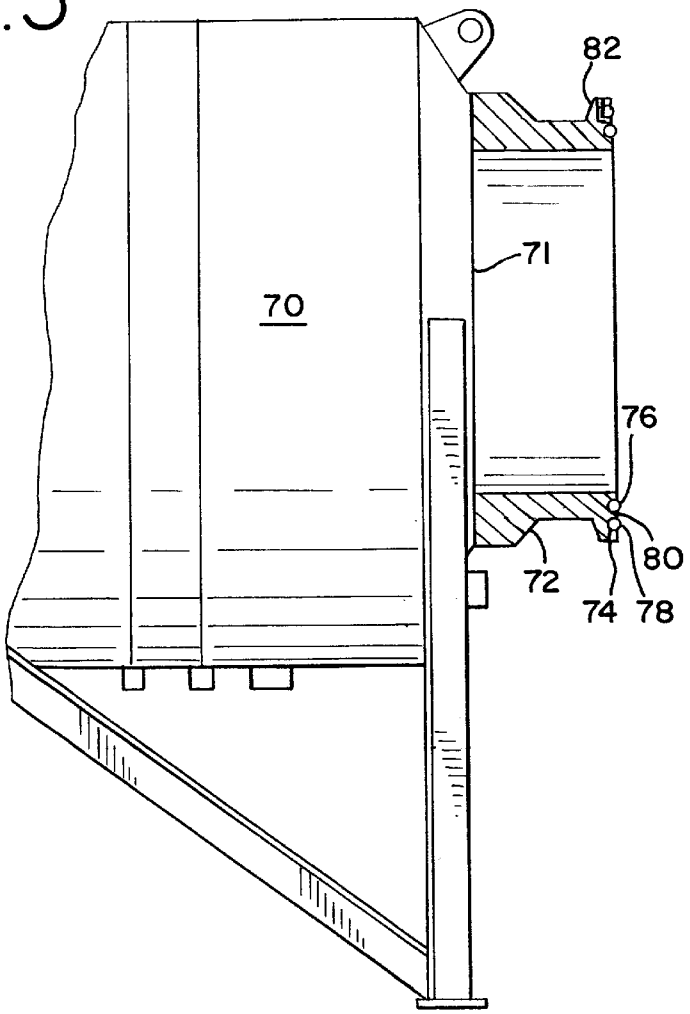
FIG. 5 is a partial side elevation view of the cleaning chamber of FIG. 4 and a sectional view of the cylindrical element of FIG. 4 taken along line 5—5.
Figure 4:
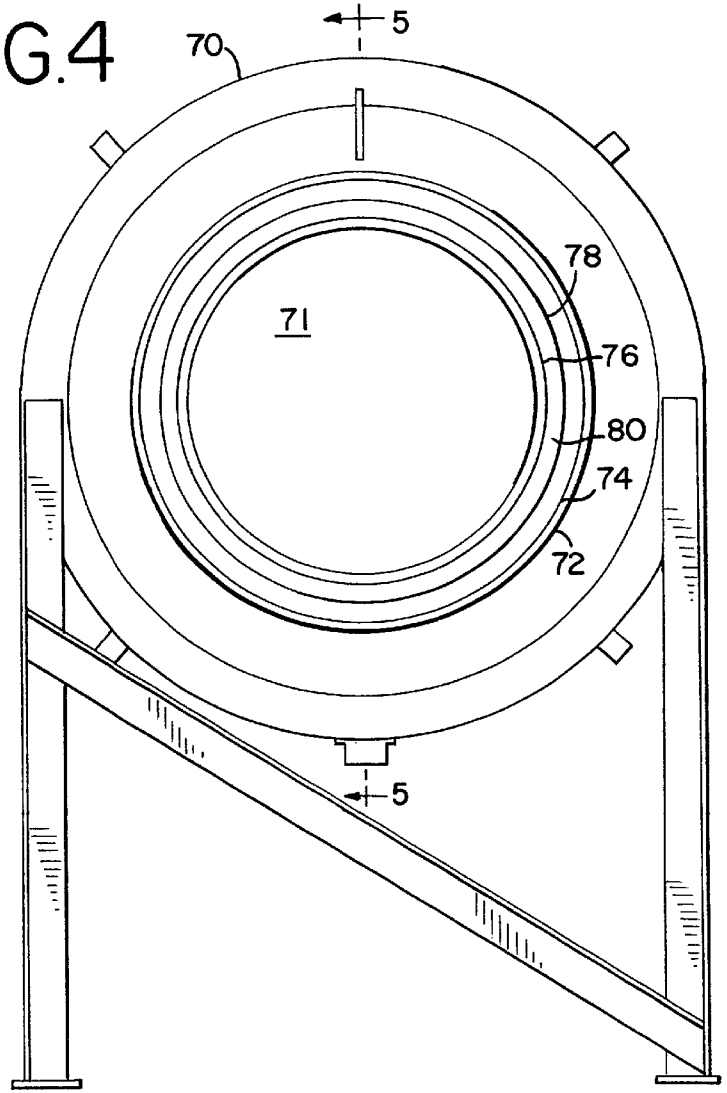
FIG. 4 is a front elevation view of the cylindrical element and cleaning chamber of an embodiment of the high pressure chamber door seal with leak detection system of the present invention.

A cleaning chamber 70 featuring an opening 71 equipped with a cylindrical element 72 constructed in accordance with an embodiment of the present invention is illustrated in FIGS. 4 and 5. The circumferential flange 74 of the cylindrical element is provided with a primary seal in the form of O-ring 76 and secondary seal in the form of O-ring 78. The concentrically-positioned primary and secondary O-ring seals are secured in position by circumferential grooves formed in circumferential flange 74. O-rings 76 and 78 may be constructed of a variety of materials including, for example, rubber. It is to be understood that while O-rings are illustrated for the primary and secondary seals, various alternative sealing elements and gaskets may be employed.

Figure 6:
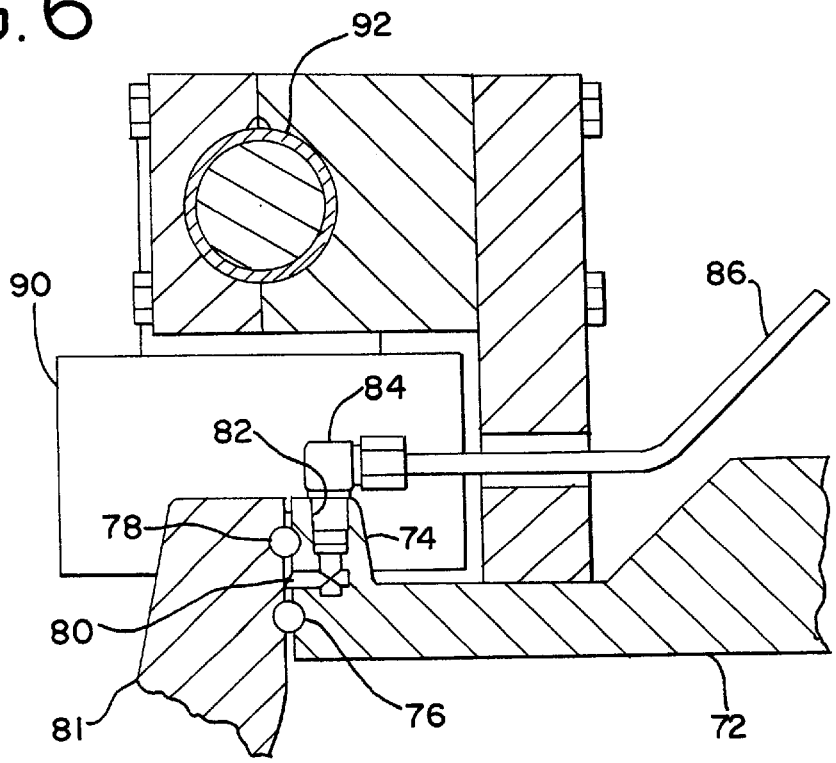
FIG. 6 is an enlarged partial section al view of the door and cylindrical element of an embodiment of the high pressure chamber door seal with leak detection system of the present invention with the door in the closed and sealed position.

An annular passage 80 is formed between the primary and secondary O-ring seals 76 and 78. As illustrated in FIG. 6, this passage becomes enclosed when a door 81 engages the cylindrical element circumferential flange 74 so that O-ring seals 76 and 78 are compressed. The door preferably is secured in the closed position with the latching arrangement of FIGS. 2 and 3. It should be noted that while the arrangement of FIGS. 2 and 3 is illustrated in FIG. 6, alternative door latching mechanisms may be utilized.

Annular passage 80 is generally sealed except for a port, illustrated at 82 in FIGS. 5 and 6. Port 82 passes through the cylindrical element flange 74 at its top-most (or "12 o'clock") position. As a result, connector 84 and tubing 86 (FIG. 6) allow communication between the port 82 and a pressure sensor or switch without interference from semi-circular segment 90 of the latching mechanism and its opposing semi-circular segment (not shown) as they are moved by bolt 92.

Figure 7:
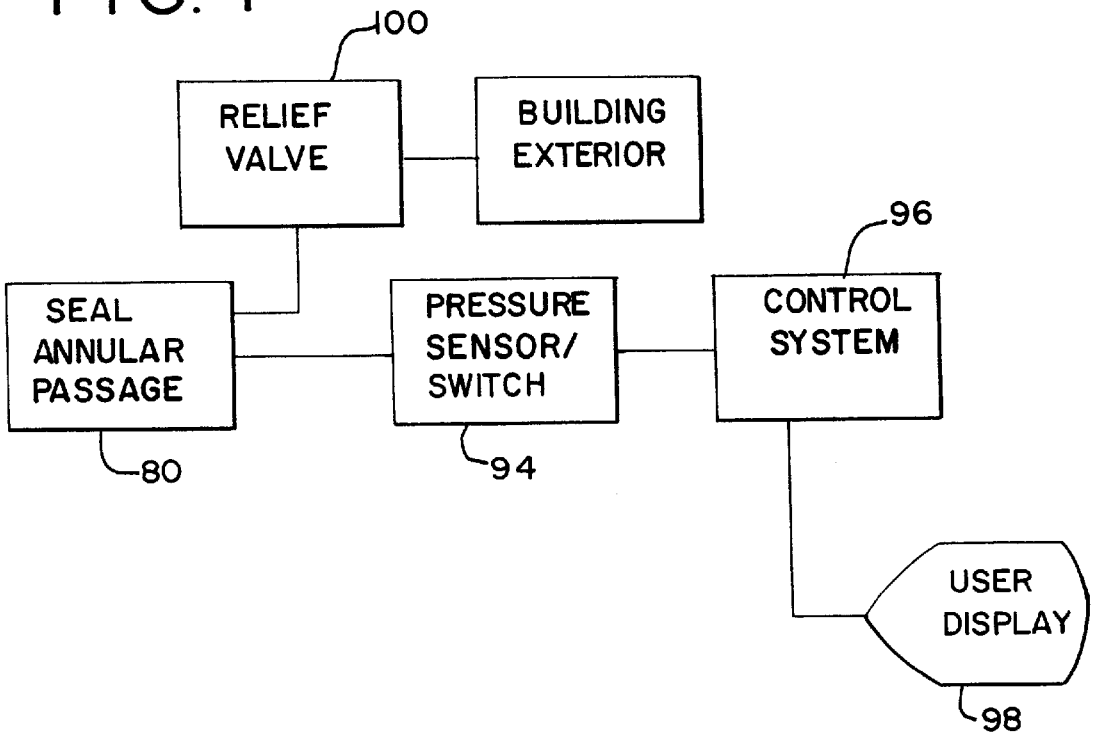
FIG. 7 is a schematic diagram showing the leak detection system and venting system of an embodiment of the high pressure chamber door seal with leak detection system of the present invention.

Due to its exposure to the pressure within the chamber 70, primary O-ring seal 76 will typically develop leaks before the secondary O-ring seal 78. Under normal operating conditions, the pressure within the annular passage is approximately atmospheric. If the primary O-ring seal develops a leak, the pressure within the annular passage 80 will begin to increase. As illustrated in FIG. 7, a pressure switch 94 is in communication with the annular passage 80. The switch is set to a low pressure such as 10 psi. When the pressure in the annular passage surpasses this level, a signal is sent to the control system 96. The control system then displays a message on the user display 98 that the primary O-ring seal is leaking. Alternatively, the control system may provide a light or audible alarm. The system operator may then inspect and repair the problem prior to the next cleaning cycle.

As illustrated in FIG. 7, the port 82, and therefore passage 80, is also in communication with a relief valve 100. The relief valve is set to open when the pressure within the annular passage rises to a level that may be detrimental to the secondary O-ring seal such as 70 psi to 90 psi. When the relief valve is opened, the contents of the annular passage are vented to the exterior of the building housing the cleaning system. The relief valve therefore ensures that the secondary O-ring is not exposed to high pressure so as to prevent leakage of solvent inside the building.

When the pressure within the annular passage 80 is at or below approximately 60 psi, the liquid carbon dioxide contained therein may convert to dry ice. Dry ice, which has a temperature of −109° F., is damaging to the O-ring seals. Accordingly, the relief valve 100 pressure setting allows the pressure in the annular passage to rise above 60 psi so as to prevent dry ice formation therein.

To summarize, the pressure sensor switch 94 and relief valve 100 cooperate to provide a signal when leakage of the primary O-ring seal (76 in FIGS. 4–6) occurs and allow the pressure within the annular space to rise to approximately 70–90 psi before venting. The latter prevents the formation of dry ice in the annular passage and prevents leakage of the secondary O-ring seal (78 in FIGS. 4–6) due to excessive pressure in the annular passage.

It is to be understood that the utility of the high pressure chamber door seal with leak detection system of the present invention is not limited to liquid carbon dioxide dry cleaning systems. For example, the invention could find use with cleaning chambers that utilize alternative solvents at high pressures to clean items other than fabrics. Indeed, the invention could be used to seal any high pressure chamber with an interior that must be accessed. It should also be understood that while a chamber with a vertical opening is illustrated and described above, the arrangement of the present invention could be utilized with a chamber that features a horizontal opening. Such chambers are typically featured by systems for degreasing mechanical parts or cleaning electrical components. The present invention may also be utilized with chambers that feature openings that are not round.

It is to be understood that the pressures and temperatures presented above are for example purposes only and that they are in no way intended to limit the scope of the invention. Furthermore, while the preferred embodiments of the invention have been shown and described, it will be apparent to those skilled in the art that changes and modifications may be made therein without departing from the spirit of the invention, the scope of which is defined by the appended claims.

What is claimed is:

1. A sealing arrangement which engages an opening of a pressure chamber containing pressurized cryogenic fluid, said sealing arrangement comprising:

a) a primary seal circumferentially surrounding the opening of the pressure chamber;

b) a secondary seal circumferentially surrounding the primary seal;

c) a door movably positioned to seal and unseal said pressure chamber opening, said door preventing a flow of fluid through the opening and engaging said primary and secondary seals to define an annular space therebetween when the chamber opening is sealed;

d) a pressure sensor in communication with the annular space so that a pressure increase within the annular space may be detected;

e) a relief valve in communication with the annular space and a space exterior to both the annular space and the pressure chamber, said relief valve set to open when a pressure within the annular space exceeds a predetermined level that is set at a pressure that prevents formation of dry ice in the annular space;

whereby leakage of the primary seal may be detected and the annular space may be vented when the pressure therein exceeds the predetermined level.

2. The sealing arrangement of claim 1 further comprising a cylindrical element circumferentially surrounding the opening of the chamber, said cylindrical element including a circumferential flange with said primary and secondary seals positioned thereon and said door removably clamped thereto.

3. The sealing arrangement of claim 2 wherein said cylindrical element includes a port in communication with the annular space and the pressure sensor.

4. The sealing arrangement of claim 3 wherein the relief valve is in communication with the port of said cylindrical element.

5. The sealing arrangement of claim 1 wherein said primary and secondary seals are O-rings.

6. The sealing arrangement of claim 1 wherein the pressure sensor is a pressure switch.

7. The sealing arrangement of claim 6 wherein the pressure switch is set to activate at a pressure of approximately 10 psi.

8. The sealing arrangement of claim 1 wherein the predetermined level whereat the relief valve opens is a pressure between and including 70 psi and 90 psi.

9. The sealing arrangement of claim 1 further comprising a user display in communication with said pressure sensor, said user display indicating when there is a pressure increase in the annular space.

10. A seal arrangement which engages the opening of a pressure chamber containing pressurized cryogenic fluid, said sealing arrangement comprising:

a) a pair of concentrically-positioned circumferential seals surrounding the opening;

b) a door engaging the circumferential seals so that an annular passage is defined therebetween and the pressure chamber opening is sealed such that fluid may not flow therethrough;

c) a pressure sensor in communication with the annular passage so that pressure increases therein may be detected; and d) a relief valve in communication with the annular passage and a space exterior to both the annular passage and the pressure chamber, said relief valve set to open when a pressure within the annular passage exceeds a predetermined level that is set at a pressure that prevents formation of dry ice in the annular passage.

11. The seal arrangement of claim 10 further comprising a cylindrical element circumferentially surrounding the opening of the chamber, said cylindrical element including a circumferential flange with said circumferential seals positioned thereon and said door clamped thereto.

12. The seal arrangement of claim 11 wherein said cylindrical element includes a port in communication with the annular passage and the pressure sensor.

13. The seal arrangement of claim 12 wherein the relief valve is in communication with the port of said cylindrical element.

14. The seal arrangement of claim 10 wherein said circumferential seals are O-rings.

15. The seal arrangement of claim 10 wherein the pressure sensor is a pressure switch.

16. The seal arrangement of claim 15 wherein the pressure switch is set to activate at a pressure of approximately 10 psi.

17. The seal arrangement of claim 10 wherein the predetermined level whereat the relief valve opens is a pressure between and including 70 psi and 90 psi.

18. The seal arrangement of claim 10 further comprising a user display in communication with said pressure sensor.

* * * * *